United States Patent [19]

McMahon

[11] Patent Number: 5,042,224

[45] **Date of Patent: * Aug. 27, 1991**

[54] ZIPPER TRACKING IN FORM, FILL AND SEAL PACKAGE MACHINES

[75] Inventor: Michael J. McMahon, Palatine, Ill.

[73] Assignee: Zip-Pak Incorporated, Northbrook, Ill.

[ * ] Notice: The portion of the term of this patent subsequent to Feb. 19, 2008 has been disclaimed.

[21] Appl. No.: 473,466

[22] Filed: Feb. 1, 1990

[51] Int. Cl.[5] ..... B65B 9/06; B65B 61/00

[52] U.S. Cl. ..... 53/133.4; 53/139.2; 53/551; 493/302; 493/923

[58] Field of Search ..... 53/128, 133, 389, 410, 53/412, 450, 451, 550, 551, 552, 139.2, 133.4; 493/302, 923

[56] References Cited

U.S. PATENT DOCUMENTS

| | | | |
|---|---|---|---|
| 3,815,317 | 6/1974 | Toss | 53/451 |
| 4,355,494 | 10/1982 | Tilman | 53/451 X |
| 4,625,496 | 12/1986 | Ausnit | 53/451 |
| 4,646,511 | 3/1987 | Boeckmann et al. | 53/551 |
| 4,666,423 | 5/1987 | Herrington | 493/439 X |
| 4,704,842 | 11/1987 | Boeckmann et al. | 53/450 |
| 4,790,126 | 12/1988 | Boeckmann | 53/451 |
| 4,840,012 | 6/1989 | Boeckmann | 53/412 X |

*Primary Examiner*—John Sipos

*Attorney, Agent, or Firm*—Hill, Van Santen, Steadman & Simpson

[57] ABSTRACT

A zipper guide tracking device and method whereby zipper profiles on package making film running over a forming shoulder about a forming and filling tube of a form, fill and seal machine are tracked in grooved tracking structure which may comprise either or both of a grooved tracking roller and a grooved tracking bar.

13 Claims, 1 Drawing Sheet

ZIPPER TRACKING IN FORM, FILL AND SEAL PACKAGE MACHINES

BACKGROUND OF THE INVENTION

The present invention relates to the art of package making with form, fill and seal machines of the type wherein a continuous sheet of package making film is shaped by a forming shoulder tubularly about a forming and filling tube, and is more particularly concerned with avoiding lateral displacement of the film sheet relative to the forming and filling tube during the shaping process.

A problem has existed heretofore due to tendency of package making sheet material of the type having a zipper longitudinally therealong intermediate side edges tending to drift or shift laterally while being shaped tubularly about the forming and filling tube or nozzle of a form, fill and seal machine. In the course of shaping of the sheet material, the longitudinal side edges of the material, which lack any means for guiding the sheet, are brought into seaming relation generally opposite the zipper, or at least substantially spaced laterally from the zipper. The zipper is intended for reclosable fastening of the mouth or top ends of packages ultimately formed from the material, while the seamed side edges of the material will form closed bottom ends of the packages. Sides of the packages are sealed closed by the customary sealing bar and pull down mechanism of the machine. By way of information, and not limitation, a disclosure of the general type of form, fill and seal package making machine with which the present invention may be useful is disclosed in U.S. Pat. No. 4,829,745, which to any extent necessary for thorough understanding of the present disclosure is incorporated herein by reference. Thereby the present disclosure may be directed sucsinctly to the present invention.

SUMMARY OF THE PRESENT INVENTION

An important object of the present invention is to provide a new and improved method of and means for avoiding lateral drifting or shifting of zippered package making film sheet in a form, fill and seal machine.

A more particular object of the present invention is to provide a new and improved drift preventing zippered film for form, fill and seal machines.

Pursuant to the present invention there is provided in a form, fill and seal machine having a film forming shoulder about a forming and filling tube and constructed and arranged for guiding a continuous sheet of package making film from an on-running side of the forming shoulder onto and into substantially tubular shape about the tube, and for guiding longitudinal side edges of the sheet into seaming relation at an off-running side of the forming shoulder, means associated with the on-running side of the shoulder for tracking profiled zipper means extending longitudinally along the sheet intermediate the side edges for avoiding lateral drifting of the sheet.

There is also provided by the present invention a method of avoiding lateral drifting of a continuous sheet of package making film in a form, fill and seal machine having a film forming shoulder about a forming and filling tube, comprising, guiding the film sheet from an on-running side of the shoulder into tubular shape about the tube, guiding longitudinal side edges of the sheet into seaming relation at an off-running side of the forming shoulder, and tracking profiled zipper means extending longitudinally along the sheet intermediate the side edges, through means associated with the on-running side of the shoulder whereby to avoid lateral drifting of the sheet.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1:
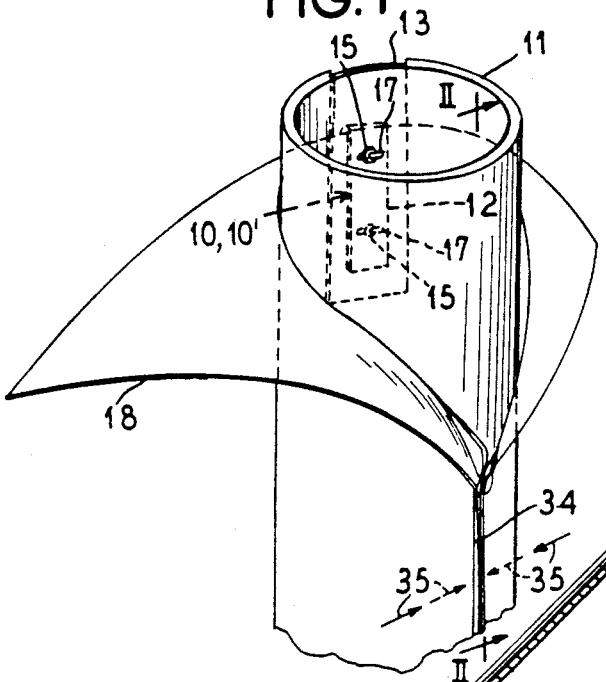
FIG. 1 is a fragmentary more or less schematic perspective view of a forming and filling tube and sheet forming shoulder structure embodying the present invention.
Figure 2:
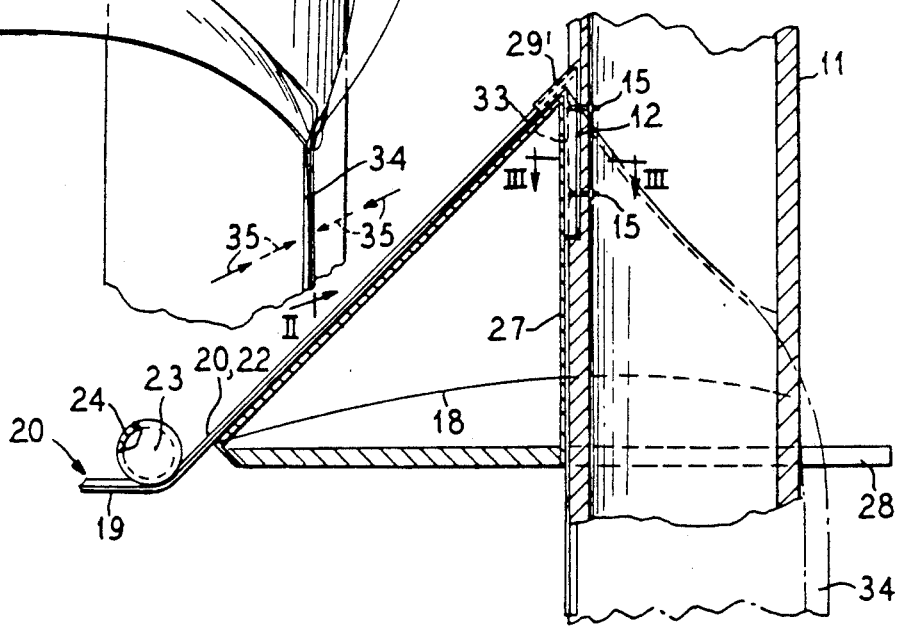
FIG. 2 is a sectional elevational view taken substantially along the line II—II in FIG. 1.
Figure 3:
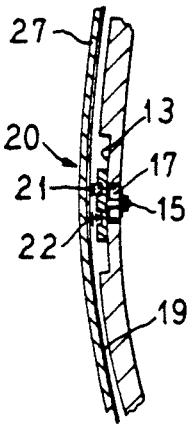
FIG. 3 is a fragmentary sectional detail view taken substantially along the line III—III in FIG. 2.
Figure 4:
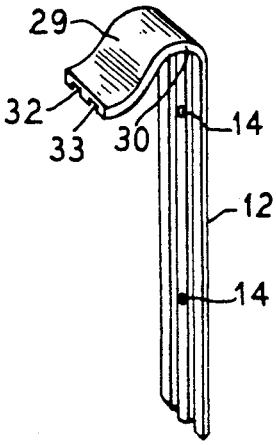
FIG. 4 is an enlarged respective view of a zipper tracking member involved in the practice of the present invention.
Figure 5:
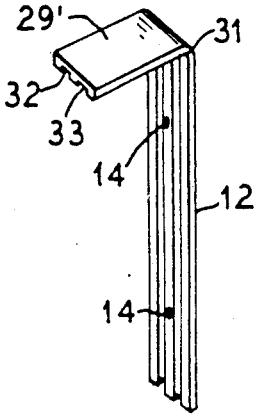
FIG. 5 discloses a slight modification of the tracking member.

As shown in FIGS. 1 and 4, a zipper guide track bar member 10 is associated with a form, fill and seal machine forming and filling tube 11, and in FIGS. 2 and 5 a slightly modified form of the zipper guide tracking bar member 10' is depicted.

Each of the members 10 and 10' has a preferably identical vertical leg portion 12 which is arranged to be mounted vertically in a vertical channel 13 provided therefor in the outer periphery of the tube 11. For mounting purposes, the leg 12 is provided with means comprising vertically spaced bolt holes to receive respective bolts 15 which extend through respective bolt holes 17 in the tube 11 substantially centered in the channel 13 which is of ample width to permit lateral adjustment of the leg 12 as permitted by transverse elongation of the bolt holes 17.

Location of the members 10 and 10' is at the top or crest edge of a forming collar or shoulder 18 of substantially conventional construction mounted about the tube 11 and formed in a manner to guide and shape tubularly about the tube 11 a sheet or film of bag or package making material 19 which is equipped intermediate its longitudinal edges with longitudinally extending extruded plastic zipper means 20 comprising adjacently spaced longitudinally extending complementary profiles 21 and 22. The profiles 21 and 22 are adapted, when the bag making material is folded intermediate the profiles, for reclosably interlocking the profiles, which in the eventual package which is to be formed from the material may be located in what will be the mouth ends of the packages.

The film 19 is drawn from a supply source (not shown) toward the forming shoulder 18 where the film is lead onto the onrunning side of the forming shoulder 18 by means of a guide roller 23 having respective guide grooves 24 through which the zipper profiles 21 and 22 are guidingly tracked whereby to assure that the film bag making material 19 approaches the forming shoulder 18 drift free and in a centered relation. From the guide roller 23 the material 19 travels up the customarily inclined surface of the shoulder 18 to a top or crest edge 25 from which the material is guided downwardly generally tubularly about the tube 11 between a skirt 27 of the shoulder 18 disposed in closely spaced relation about the tube 11. It will be understood, of course, that the advancing pull on the film 19 will be effected by means of the usual sealing and pull down bar mechanism (not shown) located operatively below the lower end of the tube 11. Suitable rigid support means which may comprise framework 28 supports the forming shoulder 18 in the form, fill and seal machine with which this apparatus is associated.

The function of the zipper guide track members 10 and 10', is to retain the package making material 19 against lateral drifting, at the crest edge 25, from the centered guidance afforded by the guide roll 23. For this purpose, the device 10 has at the upper end of the leg 12 a guiding finger 29 which overlies the crest 25, and the device 10' has a corresponding finger 29'. The only difference between the finger 29 and the finger 29' is in the longitudinal shape of the finger. For certain grades of film or sheet material, a more relieved larger radius shape including a substantial portion of the finger 29 such as the generally S-curved shape shown in FIG. 4 may be desirable, wherein the portion of the finger 29 which overlies the edge 25 joins the leg 19 on a longitudinally arched curved juncture inside corner shape 30. For other grades, the generally straight shape of the finger 29' in FIG. 5, meeting the leg 12 on a relatively small radius inside corner juncture 31 may be adequate.

The guiding function of the devices 10 and 10' is effected by means of track grooves 32 and 33 which receive the zipper profiles 21 and 22, respectively, and guide the same over the edge 25 and down the leg 12 along the adjacent face of the skirt 27. Thereby, the material 19 is accurately directed toward joining of side marginal portions of the sheet material 19 into a juncture fin 34 to be sealed into a seam by suitable sealing means schematically represented by the arrows 35 in FIG. 1. It will be understood that the fin seam 34 may be located in the tubular shape of the bag making material 19 generally diametrically opposite to the zipper 20 and may provide the bottom ends of packages to be formed from the tubularly shaped material.

It will be understood that variations and modifications may be effected without departing from the spirit and scope of the novel concepts of the present invention.

What is claimed is:

1. In a form, fill and seal machine having a film forming shoulder including an upwardly inclined onrunning side surface joining at a crest edge a downwardly extending skirt located in spaced relation about a forming and filling tube and constructed and arranged for guiding a continuous sheet of package making film, having profiled zipper means extending longitudinally along said sheet intermediate side edges of the sheet, from said onrunning side surface of the forming shoulder over said crest edge and onto and into substantially tubular shape about said tube, and said forming shoulder having means for guiding said side edges of the sheet into seaming relation at an off-running side of the forming shoulder:

means providing guide track groove structure which receives said zipper means at said crest edge and leads downwardly from said crest edge between said tube and said skirt of said shoulder for tracking said profiled zipper means for avoiding lateral drifting of the sheet relative to said tube as the sheet travels downwardly along said tube;

said guide track groove structure comprising a bar having a vertical leg and an upper finger overlying said crest edge; and said finger and said leg having continuous zipper tracking groove means.

2. A machine according to claim 1, wherein said tube has a channel in which said leg is mounted, and means for securing said leg in laterally adjustable relation in said channel.

3. A machine according to claim 1, wherein said finger has a radius juncture with said leg.

4. A machine according to claim 1, wherein said groove means comprises a plurality of parallel grooves.

5. A device for tracking zipper means on package making film caused to run over a forming shoulder which directs and wraps the film about a forming and filling tube of a form, fill and seal machine, said device comprising:

a bar having a vertical leg and an upper end finger angularly joined to the leg; and continuous groove means on said finger and leg for tracking profiled zipper on said film whereby the groove means retain the running film against drifting laterally on the shoulder.

6. A device according to claim 5, wherein said tracking groove means comprises a pair of spaced parallel grooves.

7. A device according to claim 5, wherein the angular joining is at a juncture comprising an inside radius corner.

8. A device according to claim 7, wherein said radius corner has a large radius including a substantial portion of the length of said finger.

9. A device according to claim 8, wherein said finger is of generally longitudinal S-curvature shape.

10. A device according to claim 8, wherein said finger is substantially straight to said radius corner.

11. In a form, fill and seal machine having a film forming shoulder including an upwardly inclined onrunning side surface joining at a crest edge a downwardly extending skirt located in spaced relation about a forming and filling tube and constructed and arranged for guiding a continuous sheet of package making film, having profiled zipper means extending longitudinally along said sheet intermediate side edges of the sheet, from said onrunning side surface of the forming shoulder over said crest edge and onto and into substantially tubular shape about said tube, and said forming shoulder having means for guiding said side edges of the sheet into seaming relation at an off-running side of the forming shoulder:

means providing guide track groove structure which receives said zipper means at said crest edge and leads downwardly from said crest edge between said tube and said skirt of said shoulder for tracking said profiled zipper means for avoiding lateral drifting of the sheet relative to said tube as the sheet travels downwardly along said tube;

said track groove structure comprising a member mounted on said tube.

12. A machine according to claim 11, wherein said tube has a vertical groove wherein and said member is mounted in said groove.

13. A machine according to claim 11, wherein said member has a grooved finger overlying said crest edge.

* * * * *